US005302790A

United States Patent [19]

Turpin

[11] Patent Number: 5,302,790

[45] Date of Patent: Apr. 12, 1994

[54] MICROWAVE POPCORN POPPING BAG

[75] Inventor: Charles H. Turpin, Minneapolis, Minn.

[73] Assignee: Golden Valley Microwave Foods Inc., Edina, Minn.

[21] Appl. No.: 959,681

[22] Filed: Oct. 13, 1992

Related U.S. Application Data

[63] Continuation-in-part of Ser. No. 852,291, Mar. 16, 1992, abandoned.

[51] Int. Cl.[5] ..... H05B 6/80

[52] U.S. Cl. ..... 219/727; 219/730; 219/732; 426/107; 426/113; 426/234; 426/243; 99/DIG. 14; 383/100; 383/126; 53/434

[58] Field of Search ..... 219/10.55 E, 10.55 F, 219/10.55 M, 10.55 D; 426/107, 110, 113, 124, 234, 243; 99/DIG. 14; 383/100, 126, 104; 53/434, 449

[56] References Cited

U.S. PATENT DOCUMENTS

| | | | |
|---|---|---|---|
| 1,944,089 | 1/1934 | Litchfield | 158/9 |
| 3,357,152 | 12/1967 | Geigel | 53/29 |
| 3,381,574 | 12/1974 | Katz et al. | 426/107 |
| 3,973,045 | 8/1976 | Brandberg et al. | 426/110 |
| 4,038,425 | 7/1977 | Brandberg et al. | 426/107 |
| 4,219,573 | 8/1980 | Borek | 426/107 |
| 4,355,757 | 10/1982 | Roccaforte | 229/33 |
| 4,450,180 | 5/1984 | Watkins | 426/107 |
| 4,453,665 | 6/1984 | Roccaforte et al. | 229/41 B |
| 4,477,705 | 10/1984 | Danley et al. | 219/10.55 E |
| 4,584,202 | 4/1986 | Roccaforte | 426/111 |
| 4,586,649 | 5/1986 | Webinger | 426/111 |
| 4,698,472 | 10/1987 | Cox et al. | 219/10.55 E |
| 4,727,706 | 3/1988 | Beer | 53/434 |
| 4,735,513 | 4/1988 | Watkins et al. | 383/116 |
| 4,904,488 | 2/1990 | La Baw et al. | 426/107 |
| 4,948,932 | 8/1990 | Clough | 219/10.55 E |
| 4,973,810 | 11/1990 | Brauner | 219/10.55 E |
| 4,982,064 | 1/1991 | Hartman et al. | 219/10.55 E |
| 5,011,299 | 4/1991 | Black, Jr. et al. | 383/126 |
| 5,044,777 | 9/1991 | Watkins et al. | 383/100 |
| 5,081,330 | 1/1992 | Brandberg et al. | 219/10.55 E |
| 5,097,107 | 3/1992 | Watkins et al. | 219/10.55 E |
| 5,153,402 | 10/1992 | Quick et al. | 219/10.55 E |

*Primary Examiner*—Bruce A. Reynolds
*Assistant Examiner*—Tu Hoang
*Attorney, Agent, or Firm*—James V. Harmon

[57] ABSTRACT

For popping popcorn in a microwave oven, a flexible bag is provided which contains popcorn and includes a collapsible stand. The bag has upper and lower opposing face panels connected together by longitudinally extending, centrally projecting gussets that are integral with the face panels. Prior to popping, the gussets are folded between the upper and lower face panels of the bag. The panels and gussets are preferably formed from a pair of superimposed sheets of paper that are laminated together with adhesive. Popcorn is placed in the bag and the bag ends are sealed. A microwave heating susceptor of any suitable type is provided in the lower panel of the bag or elsewhere in the bag if desired. During popping of the popcorn kernels, the bag increases in size and the gussets expand outwardly as the bag becomes filled with popped kernels, hot vapor and steam. To ensure that microwave energy will transfer well to the popcorn so that the popcorn pops efficiently, popping can be conducted with the stand folded flat, i.e., collapsed in certain ovens or, if desired, popping can be carried out with the stand erected so as to elevate the lower panel of the bag about 2 cm from the supporting surface of the microwave oven.

7 Claims, 3 Drawing Sheets

MICROWAVE POPCORN POPPING BAG

This is a continuation-in-part of prior application Ser. No. 07/852,291, filed Mar. 16, 1992, entitled SPACE-EFFICIENT MICROWAVE POPCORN POPPING BAG AND METHOD.

FIELD OF THE INVENTION

This invention relates to a microwave corn popping bag.

BACKGROUND OF THE INVENTION

At the time microwave popcorn was first commercialized, microwave popcorn bags were sized to be the largest size that would fit in the most commonly available ovens in use at the time. A de facto standard size of about 100 grams resulted. This size has come to be preferred by microwave popcorn customers, with sizes larger, and especially smaller, being much less acceptable as shown by relative sales volume.

This size fits and works well in most of today's microwave ovens. However, there is one class of oven where this size does not work well—and that is the class of oven wherein a turntable is used to enhance uniformity of heating. In such ovens, if the 100 gram bag is too close to the maximum space capacity of the oven, the bag can catch or hang up and so no longer rotate, thus inactivating the uniformity of heating feature of the oven turntable, resulting in reduced pop volume and sometimes even scorching. Such small ovens may often have a turntable of about 23 cm or less in diameter and are very common in some markets, making it unfeasible to market the most popular bag size in those markets. In fact, the largest de facto standard size that will fit these ovens is the 50 gram size, which uses a bag having a height of only about 23 cm and a width of about 10 cm across each face.

Another problem in certain microwave ovens is that the area of maximum field intensity is in an unusual position owing to the design of the oven cavity or the presence of a metal cooking surface. For example, in a typical Japanese oven it has been found that the maximum field intensity is not located at or immediately above the support surface within the oven as it is in typical U.S. ovens. Japanese ovens are characterized by the presence of a metal cooking surface, i.e., a metal support surface such as a turntable for the food at the bottom of the oven compartment. Foods like popcorn which depend on an electric field powered susceptor in the bottom of a paper container, e.g., a bag, are not heated very well in ovens of this kind. As a result, the popcorn pops slowly, and very often popping is incomplete, resulting in a large number of unpopped kernels which consumers find unacceptable. In addition, heating may be spotty, causing popcorn in some parts of the bag to burn or kernels in other portions of the package remain unpopped. This is a particularly serious problem to the consumer who often perceives the packaged popcorn as a poor product and may never buy it again. By contrast, other ovens such as those commonly marketed in the United States exhibit a maximum microwave field intensity that is positioned very close to the cooking surface (the oven floor), e.g., about one-sixteenth to about one-eighth inch above the cooking surface so that the microwave energy is transmitted very efficiently to the susceptor of a packaged food product resting directly on the floor of the oven.

A major objective of the present invention is to provide an improved microwave popcorn popping bag in which energy can be transmitted efficiently to the susceptor in both of the above types of ovens. A more specific objective is to find a way of mass producing an inexpensive disposable paper bag that can be placed selectively in either of two or more positions within the microwave oven to assure popping at maximum efficiency. Another more specific object is to provide an inexpensive popcorn bag that can be mass produced efficiently and in which cooking can be carried out in either a raised or a lowered position.

These and other more detailed and specific objects of the invention will be better understood by reference to the following detailed description and figures which illustrate by way of example but a few of the various forms of the invention within the scope of the appended claims.

SUMMARY OF THE INVENTION

Briefly, for the purpose of popping popcorn in a microwave oven, the present invention provides a flexible bag containing popcorn and having a collapsible stand as a part of the bag. The bag includes upper and lower face panels defining the major faces of the bag. Connected to and extending between the faces of the bag are left and right longitudinally extending, centrally projecting gussets that are integral with the face panels. Prior to popping, the gussets are folded between the upper and lower face panels of the bag. The panels and gussets are preferably formed from a pair of superimposed sheets of paper that are laminated together with adhesive. Popcorn is placed in the bag and the bag ends are sealed. A microwave heating susceptor of any suitable type is provided in the lower panel of the bag. If desired, the bag ends can be cut in an arcuate configuration, either as a continuously curved convex arc or as several straight adjoining cut segments. During popping of the popcorn kernels, the bag increases in size and as this happens, gussets expand outwardly as the bag becomes filled with popped kernels, hot vapor and steam.

To ensure that microwave energy will couple well with the popcorn so that the popcorn pops efficiently, the bag has a stand capable of collapsing by being folded flat for shipment and storage. When erected, the stand elevates the lower panel of the bag about 2 cm from the supporting surface within the microwave oven cooking chamber.

THE FIGURES

DETAILED DESCRIPTION OF THE INVENTION

Figure 1:
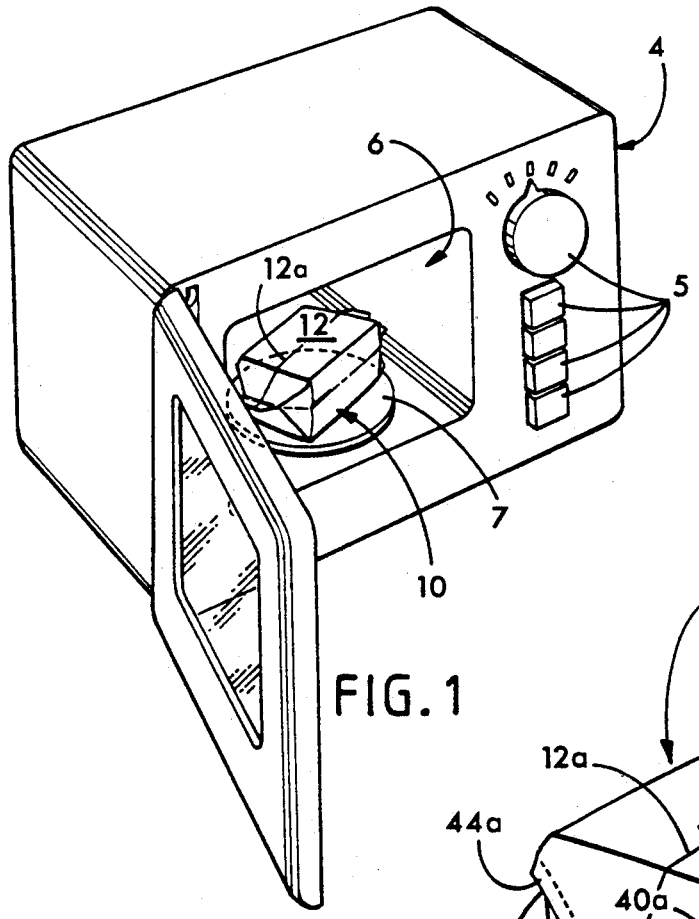
FIG. 1 is a perspective view of a microwave oven holding a bag in accordance with the invention as it appears just after popping.

Refer now to the figures. Shown in FIG. 1 is a microwave oven 4 having the usual controls 5 and an oven cooking chamber 6 provided with a rotatable turntable 7 upon which is placed a popcorn bag 10 embodying one alternative form of the invention. In FIGS. 1, 2, 4 and 5 the popcorn bag 10 is shown as it appears in the expanded condition during and immediately after popping.

The bag 10 is composed of flexible microwave transparent sheet material, preferably of a pair of paper plies 10*a* and 10*b* (FIG. 2) that are superimposed and sealed together by means of adhesive, i.e., laminated to one another to form a composite structure. The composition of the bag 10, adhesives used, and its mode of assembly, etc., can be as described in any of the following patents which are incorporated herein by reference: U.S. Pat. Nos. 4,691,374; 4,735,513; 4,878,765; 4,450,180; 5,044,777 or 5,081,330.

The bag 10 includes a flat upper face panel 12 and a flat lower face panel 14. The upper face panel 12 is provided with a longitudinally extending, adhesively bonded seam 12*a* that bonds the edges of the cut sheet from which the bag is formed together along the length of the bag. Extending longitudinally of the bag 10 between the face panels 12, 14 are a pair of longitudinally extending, centrally projecting folded gussets 16 and 18 which are integral with face panels 12 and 14.

Within the bag 10 is a charge 13 of popcorn, preferably together with a quantity of shortening. Bonded between the plies 10*a*, 10*b* beneath the charge 13 of popcorn and shortening is a susceptor 14*b*. While any suitable type of susceptor known to the art can be employed, the susceptor 14*b* preferably comprises a thin sheet of plastic such as 0.5 mil polyethylene terephthalate having a thin semiconductive coating of metal, e.g., aluminum, vacuum electrodeposited thereon for absorbing microwave energy and converting it to heat.

Figure 2:
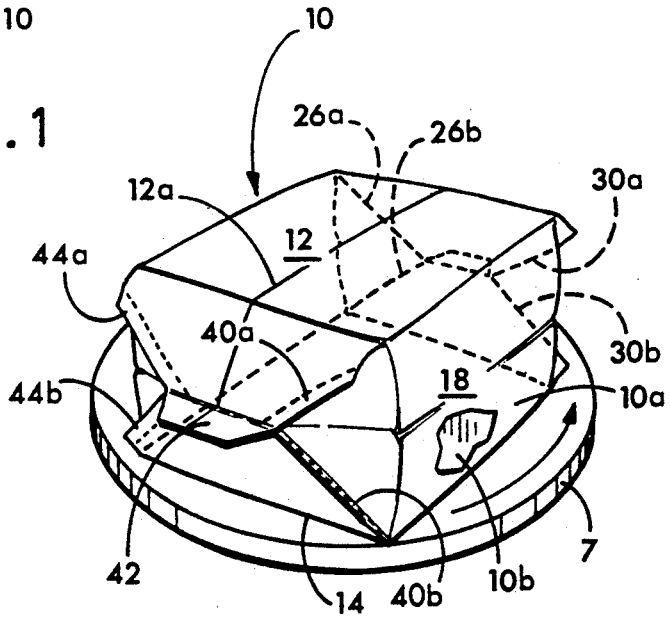
FIG. 2 is an enlarged perspective view of the turntable and popcorn bag illustrated in FIG. 1 as it appears after it has been fully inflated and the corn has been popped.
Figure 3:
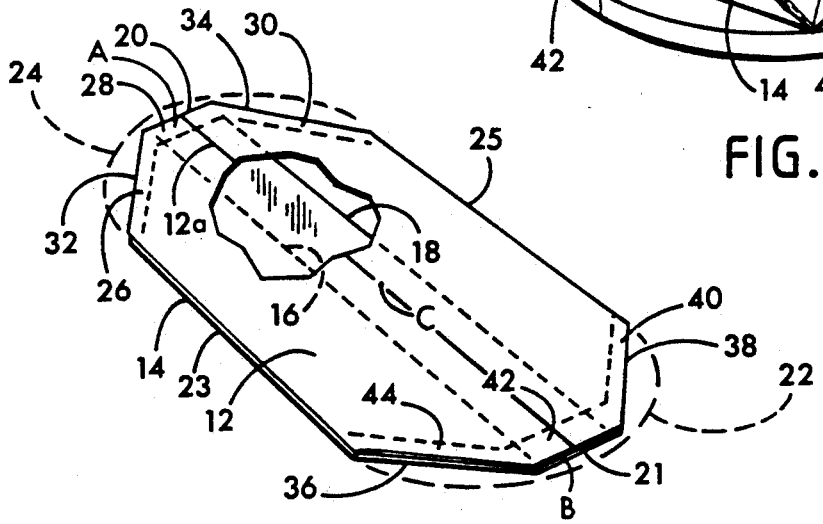
FIG. 3 is a perspective view of the package in a collapsed condition as it appears prior to popping of the corn.

The ends of the optional form of the bag 10 shown in FIGS. 1-5 are cut in a particular way. Other embodiments to be described below have straight cut ends. As shown in FIG. 3, the bag 10 is provided with a top end A and a bottom end B. The top end A is provided with an arcuate cut edge which can, if desired, either be in the form of a continuously curved convex arc 22 or, as shown in the figure, composed of several straight adjoining cut segments, in this case a straight center segment 20 and inclined cut segments 34 and 32 proceeding outwardly and downwardly from the central centermost segment 20. The top end A of the bag 10 is glued together by means of three adhesive strips 26, 28 and 30 which are aligned with the cut edges 32, 20 and 34, respectively.

Similarly, the bottom end B of the bag 10 is provided with an arcuately contoured cut end composed of three straight segments 36, 21 and 38 joined end-to-end to form a convex arc. The panels and gussets are bonded together by means of an arcuate line of adhesive composed of segments 40, 42 and 44 aligned with the cut edges 38, 21 and 36, respectively. Similarly, the contoured arcuate bottom cut end B of the bag can be a continuously curved arc as shown at 24, if desired, rather than being formed of several connected straight segments. The arcuate cut ends A and B of the bag 10 both have a convex shape with respect to the center of the bag and can, if desired, form a convex arc such as a circular or elliptical arc about the center point C of the bag 10.

By viewing FIG. 2, it will be seen that the adhesive line 40 consists of a pair of adhesive bonds 40*a* and 40*b* between the gusset fold 18 in the upper and lower face panels 12 and 14. Similarly, the adhesive line 44 includes an upper segment 44*a* and a lower segment 44*b* which bond the gusset 16 and the upper and lower face panels. The adhesive line 42 bonds the face panels 12 and 14 between the gusset folds 16 and 18.

Refer now to FIG. 3 which illustrates clearly how the gussets are cut in the embodiment of FIGS. 1-5. It will be seen that the height of each of the gussets 16 and 18 is greatest near the center of the bag but diminishes proceeding laterally toward the side edges 23 and 25 of the bag 10. The gusset will thus have a generally trapezoidal configuration prior to popping when the bag is flat as in FIG. 3. Each end of each gusset 16, 18 is securely bonded to the adjacent face panels 12, 14 by means of the lines of adhesive 26*a*, 26*b*, 30*a*, 30*b*, at the top of the bag and 40*a*, 40*b*, 44*a*, 44*b* at the bottom of the bag.

Figure 4:
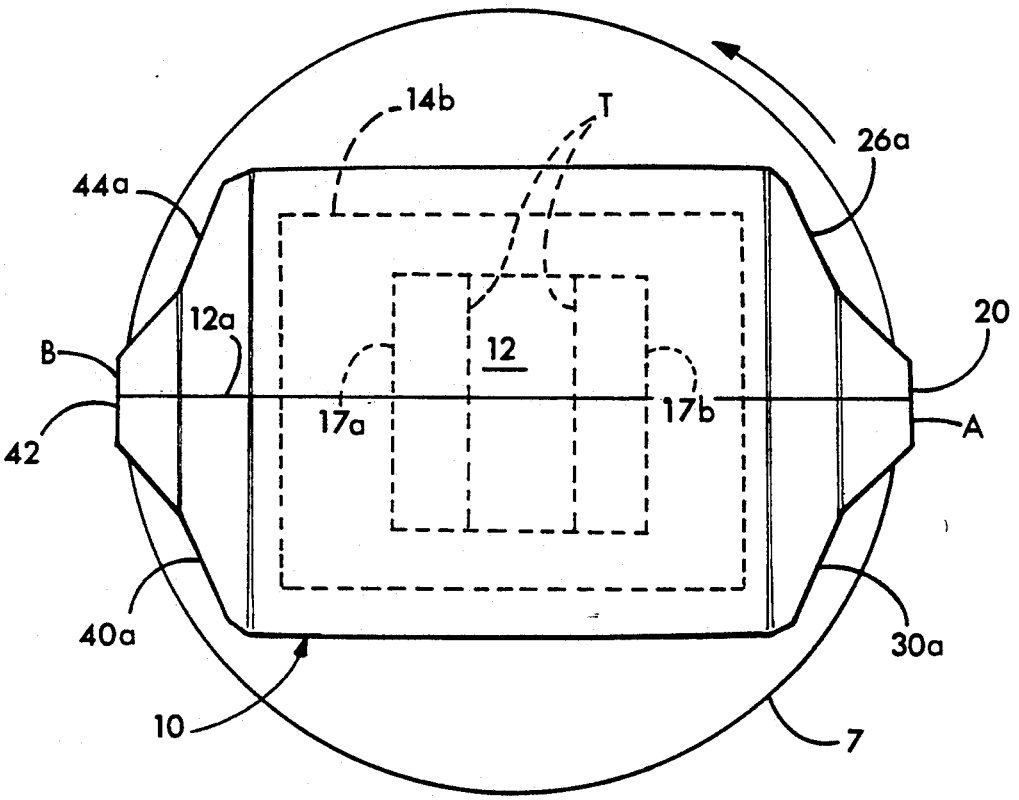
FIG. 4 is a top view of the package of FIG. 2 after popping.
Figure 5:
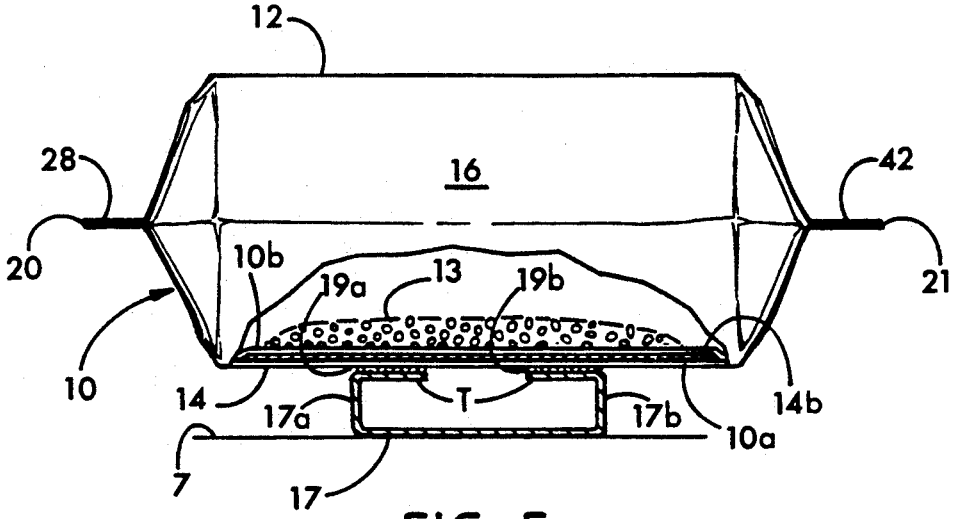
FIG. 5 is a side view of the package after popping.
Figure 6:
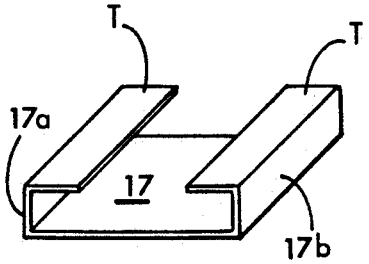
FIG. 6 is a perspective view of the collapsible stand illustrated in FIGS. 4 and 5 as seen before it is bonded to the lower surface of the bag.
Figure 6A:
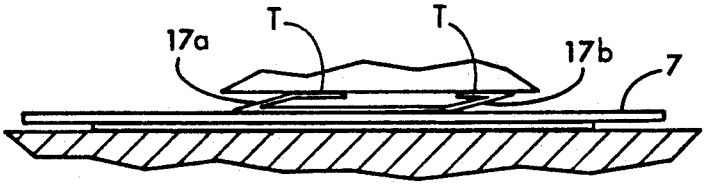
FIG. 6A is a partial side elevational view of the bag with the stand in a partially collapsed position.

Bonded as shown in FIGS. 4, 5 and 6A, e.g., by means of adhesive, to the bottom of the bag 10 is a stand 17 formed, for example, from microwave transparent paperboard having a pair of upright segments 17*a* terminating in centrally folded tabs T which are bonded by being glued to the bottom panel 14 of the bag 10 for supporting the bag at a height of, say, about 2 cm above the turntable 7. It will be noted that the tabs T are relatively small in size compared to the susceptor 14*b*. This will help to avoid overheating of the susceptor 14*b*. The stand 17 in this case includes a central rectangular bottom panel designated by the numeral 17*c* (FIGS. 5 and 6). Fold lines 17*d*, i.e., pre-formed creases in the paperboard, define the intersection between the tabs T, the upright segments 17*a* and 17*b*, and the lower panel 17*c*. The stand 17 is in this way collapsible so that it will function both in the collapsed position illustrated in FIG. 6A or, by folding the adjoining panels along the fold line 17*d* to an erect position, in the erect position shown in FIG. 5. Accordingly, the stand 17 can be used to position the bag 10 in at least two alternate positions at different elevations for different applications; namely, by placing the stand 17 in an erect position (FIGS. 4-6) or a collapsed position (FIG. 6A) to suit whatever conditions exist in the particular oven in which the popcorn bag 10 is cooked. The stand 17 can thus be thought of as a collapsible stand suited for positioning the bag 10 at selected positions within the oven, namely, at two or more elevations; one position (when the stand 17 is collapsed) locating the popcorn within the bag 10 very close to the oven supporting surface and the second position (when the stand 17 is erect) locating the bottom wall 17*c* of the bag 10 in a raised position in spaced relationship with the oven supporting surface, e.g., the oven turntable 7, and in this way placing the popcorn as well as the susceptor 14b where both will efficiently absorb the microwave energy to pop the corn more completely and evenly. When the stand 17 is folded halfway or to any other intermediate position, it will support the bag 10 at some intermediate position between the raised and lowered position to suit any kind of oven encountered.

The bottom seal B is made very strong to prevent it from popping open due to internal pressure prior to the top seal A in any suitable manner. This can be accomplished in any suitable way as by having the bottom seal 42 extend further toward the top of the bag, thereby intersecting the seals 40, 44 higher up so that the seals become redundant. The seal at the top A of the bag is preferably made somewhat weaker than the bottom seal B to provide a normally closed steam vent that opens at the top responsive to internal steam pressure. The seal A thus opens to provide for the escape of excess steam from the top of the bag during the popping operation.

In a typical example of the invention, the bag is 28 cm long, each face is 13 cm wide, the gussets are 5 cm deep (10 cm across), and the height of the stand 17 is 1.9 cm. Such a bag will have a capacity of 2600 cc and will hold a charge of 100 grams of popcorn and shortening, and replaces a standard rectangular 1600 cc bag that was able to hold a charge of only 50 grams, the largest that could previously be used with a standard 23 cm turntable.

Figure 7:
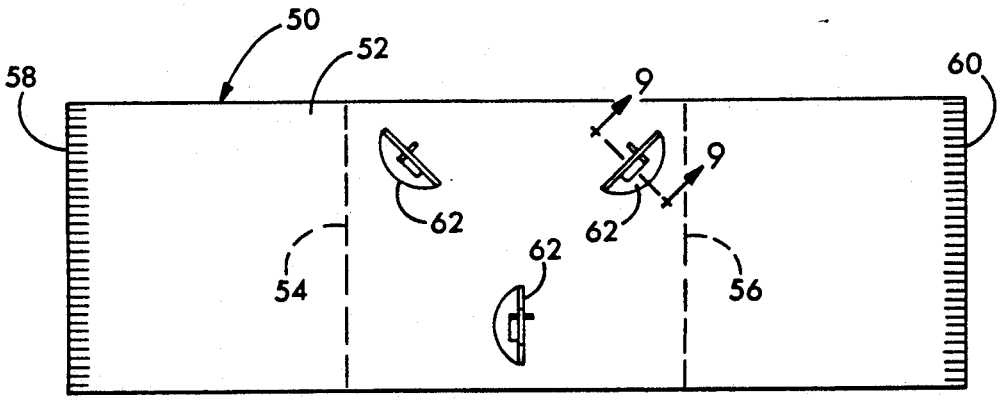
FIG. 7 is a plan view of the lower surface of a popcorn popping bag having another form of collapsible stand.
Figure 8:
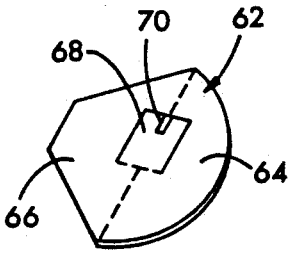
FIG. 8 is a perspective view of one of the legs of the stand shown in FIG. 7.
Figure 8B:
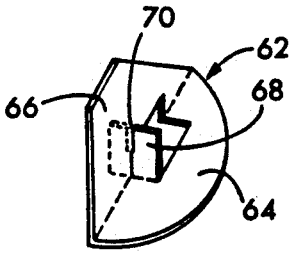
FIG. 8B is a perspective view of the leg of FIG. 8 folded to its erect position.
Figure 9:
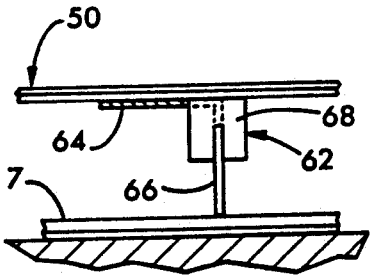
FIG. 9 is a partial vertical sectional view taken on line 9—9 of FIG. 7 on an enlarged scale.

Refer now to FIGS. 7-9 which illustrate another embodiment of the invention. In this case, the popcorn bag 50 is generally similar to the bag 10 of FIGS. 1-5 except that the ends are cut straight. Thus, the bag 50 includes an upper rectangular panel 51 and a lower panel 52 of the same shape. The panels 51, 52 are connected together along the side edges by means of centrally extending gusset folds 53 and 55. In the lower panel 52 is provided a microwave heating susceptor 52a which becomes hot when exposed to microwave energy. The bag 50 is provided with longitudinally spaced apart, laterally extending fold lines 54, 56 that enable the bag to be folded into thirds for compact shipment. The ends of the bag 50 are cut straight across and thus have straight ends 58 and 60 at the ends. The ends of the bag 50 are sealed shut all the way across by means of a suitable adhesive providing straight seals adjacent to the straight cut ends 58 and 60. To the lower panel 52 of the bag 50 is bonded a stand as a part of the bag 50 which consists of three foldable legs 62 formed from paperboard or from a sheet of foldable plastic. Each of the legs 62 has a base portion 64 that is bonded to the lower wall 52 of the bag 50 and an adjacent leg portion 66 which is connected to the base 64 by means of a preformed crease or fold line 65. When the bag 50 is shipped, the legs 62 are in the collapsed condition of FIG. 8. However, when the bag 50 is to be used on turntable 7, the leg portions 66 are folded to the erect position shown in FIGS. 7, 8B and 9, and a centrally located foldable tab 68 is also elevated to an erect position as shown in FIG. 8B so that a slot 70 engages the leg portion 66 to securely hold the leg portion 66 in its erect position. As in the first embodiment, when the legs 62 are collapsed, the bag 50 can be placed in the microwave oven in a lower position, but if the legs 62 are erected, the bag 50 will be elevated in spaced relationship to the bottom wall of the microwave oven to an elevated position as shown in FIG. 9 so as to substantially increase cooking efficiency, particularly by enhancing energy transfer to the susceptor 52a when the oven floor or food support is composed of metal.

Commercial Application and Results

The present invention was employed for popping popcorn in four different kinds of microwave ovens. In all of the tests, identical standard commercial production popcorn bags were employed of a type manufactured by the assignee, Golden Valley Microwave Foods, Inc., with a nominal capacity of 3.5 ounces. Some of the bags had stands attached as described herein, and other control bags had no stand.

All of the bags were filled with 71 gms. of corn and 29 gms. of shortening, salt and butter flavoring. The net weight of all bags tested within +/−1.5 gms. of the target weight.

For the invention bags, the top and bottom ends were cut diagonally as shown herein in FIGS. 1-5. The stand employed was glued to the lower surface of each bag below the susceptor, as shown in FIGS. 4 and 5.

The tests involved three runs in each oven. Each run consisted of the control bag with no stand, the invention bag with stand folded flat, i.e., collapsed, and the invention bag with stand erected. The ovens were allowed to cool off between the second and third runs.

The response was the volume of popped corn as measured to the nearest 100 cc., using the same apparatus and technique for every measurement.

The results are summarized in the table below:

TABLE

AVERAGE POPPED VOLUMES (cc)

| Oven Type | Control Bag (no stand) | Invention (Stand folded to collapsed position) | Invention (Stand erected) |
|---|---|---|---|
| Metal Cooking Surface* 600w, small cavity turntable | 2067 | 2100 | 2600 |
| Metal cooking surface* 600w, larger cavity turntable | 1300 | 1900 | 2700 |
| Ceramic cooking surface* 450w, small cavity no turntable | 1750 | 1900 | 1500 |
| Ceramic cooking surface* 655w, larger cavity turntable | 2700 | 2800 | 2500 |

*i.e., surface below bag at floor of oven cavity

It will be seen in the Table that when the bags are placed on a metal cooking surface, erecting the stand will provide a substantial improvement in the volume of popped corn that results. On the other hand, where the ovens have a ceramic cooking surface, maintaining the stand in the collapsed position will result in the greatest volume of popped corn. Consequently, the invention provides a unique capability of maximizing the volume of popped corn in ovens with either a metal or a ceramic floor.

Many variations of the present invention within the scope of the appended claims will be apparent to those skilled in the art once the principles described herein are understood.

What is claimed is:

1. An expandable popcorn bag for microwave popping of popcorn comprising, a bag body formed from flexible microwave transparent sheet material including superimposed upper and lower face panels having parallel left and right side edges, longitudinally extending centrally projecting gussets folded between the upper and lower face panels, said bag having top and bottom cut ends, top and bottom seals aligned adjacent to the cut ends of the bag, said seals bonding the upper and lower face panels together and bonding the gussets between the face panels to seal the ends of the bag whereby said bag expands to accommodate expansion of popcorn as the popcorn pops therein during microwave cooking, said lower face panel having a microwave heating susceptor for absorbing microwave energy to enhance the popping of said popcorn, a collapsible stand as a part of the bag bonded to an outside surface of the lower face panel of said bag below the susceptor for supporting said bag in spaced relationship above a cooking surface when the stand is erected, said stand is folded to a collapsed condition so that said stand occupies a reduced space during shipment and storage, said stand enables the bag to be placed in selected positions within said microwave oven during cooking including a) a lower position when the stand is folded to the collapsed condition and b) a raised position when the stand is folded to an erect condition, said stand being thereby adapted to support the bag in said selected positions during cooking while the bag remains sealed for improving cooking efficiency in microwave ovens, said stand comprises base portions adhesively bonded to an outer surface of said lower panel of the bag, at least two upright panels spaced apart from one another and connected to said base portions by means of fold lines whereby the upright panels serve as legs for supporting the bag in a raise position when the stand is erected and the legs are upright, and means for securing at least one of said legs in an erect position.

2. The popcorn bag of claim 1 wherein said susceptor comprises a sheet of susceptor material located at said lower force panel of said bag to which said stand is attached.

3. The popcorn bag of claim 1 wherein the susceptor is attached to the lower face panel and said susceptor comprises a thin film of plastic resinous material having a semiconductive metal-containing coating thereon for converting microwave energy to heat for enhancing cooking of the popcorn and said stand is bonded to an outside surface of the lower face panel proximate to said susceptor.

4. The popcorn bag of claim 1 wherein the bag has top and bottom cut ends and each of the cut ends is contoured to provide a convex arcuate cut end at each end of the bag, arcuate lines of adhesive are aligned adjacent to the convex arcuate cut ends of the bag, said arcuate lines of adhesive bond said face panels together and bond the gussets between the face panels, the gussets have top and bottom cut ends, the top and bottom cut ends of the gussets are cut so that the length of each gusset is greatest near the center of the bag and diminishes proceeding outwardly toward side edges of each face panel.

5. The popcorn bag of claim 4 wherein the arcuate-cut ends of the bag and gussets are curved arcs.

6. The popcorn bag of claim 4 wherein the arcuate cut ends of the bag are formed from a plurality of straight segments connected end-to-end.

7. The popcorn bag of claim 1 wherein the stand includes a bottom panel connected between the lower ends of said legs by spaced apart mutually parallel fold lines which are also positioned parallel to said fold lines between said base portions and said legs.

* * * * *